US005736966A

United States Patent [19]

Reits

[11] Patent Number: 5,736,966

[45] **Date of Patent: *Apr. 7, 1998**

[54] ADJUSTABLE MICROWAVE ANTENNA

[75] Inventor: Bernard Jozef Reits, Hengelo, Netherlands

[73] Assignee: Hollandse Signaalapparaten B.V., Hengelo, Netherlands

[ * ] Notice: The term of this patent shall not extend beyond the expiration date of Pat. No. 5,585,812.

[21] Appl. No.: 690,947

[22] Filed: Aug. 1, 1996

Related U.S. Application Data

[63] Continuation of Ser. No. 425,644, Apr. 20, 1995, Pat. No. 5,585,812.

[30] Foreign Application Priority Data

| | | | |
|---|---|---|---|
| Apr. 29, 1994 | [NL] | Netherlands | 9400700 |
| May 26, 1994 | [NL] | Netherlands | 9400863 |

[51] Int. Cl.[6] ..... H01Q 15/02; H01Q 15/23

[52] U.S. Cl. ..... 343/910; 343/909

[58] Field of Search ..... 343/753, 755, 343/910, 911 R, 911 L, 909; H01Q 15/02, 15/08, 15/23, 15/24

[56] References Cited

U.S. PATENT DOCUMENTS

| | | | |
|---|---|---|---|
| 3,273,155 | 9/1966 | Raabe | 343/910 |
| 3,530,475 | 9/1970 | Danielson | 343/910 |
| 3,848,255 | 11/1974 | Migdal | 343/911 L |
| 4,905,014 | 2/1990 | Gonzalez et al. | 343/910 |
| 5,389,944 | 2/1995 | Collinge et al. | 343/910 |
| 5,585,812 | 12/1996 | Reits | 343/910 |

FOREIGN PATENT DOCUMENTS

| | | | |
|---|---|---|---|
| 2236019 | 3/1991 | United Kingdom | H01Q 15/23 |
| 2278020 | 11/1994 | United Kingdom | H01Q 15/23 |
| 9001813 | 2/1990 | WIPO | H01Q 15/02 |

*Primary Examiner*—Hoanganh T. Le
*Assistant Examiner*—Tan Ho
*Attorney, Agent, or Firm*—Oblon, Spivak, McClelland, Maier & Neustadt, P.C.

[57] ABSTRACT

The invention relates to a microwave antenna for the generation of a beam with adjustable parameters. Use is made of a reflective Fresnel zone plate that is written into a thin layer of silicon by means of a laser plus deflection means. A reflector is positioned behind the Fresnel zone plate for reflecting microwave radiation that is not reflected by the Fresnel zone plate.

11 Claims, 1 Drawing Sheet

ADJUSTABLE MICROWAVE ANTENNA

This is a continuation of application Ser. No. 08/425,664 filed on Apr. 20, 1995 now U.S. Pat. No. 5,585,812.

BACKGROUND OF THE INVENTION

The invention relates to a microwave antenna for the generation of an antenna beam with adjustable parameters, provided with an active microwave radiation source, a Fresnel zone plate for generating the antenna beam and display means for displaying the Fresnel zones on the Fresnel zone plate.

Such a microwave antenna is described in WO 93/26059-A1. The antenna described in said document operates in a transmission mode and has the drawback that 3 dB of the incident microwave radiation remains unused. In a radar system that incorporates this microwave antenna, this results in a 6 dB system loss, 3 dB at transmission and 3 dB at the reception of radiation reflected by a target. Since microwave antennas of this type are particularly suitable for applications at higher frequencies, where microwave generators are expensive and have a limited power, this 6 dB loss is a serious drawback.

In addition, such losses give often rise to the occurrence of unexpected sidelobes of the antenna system via multiple reflections. It is therefore of particular importance to actually transmit all energy available in the antenna beam.

SUMMARY OF THE INVENTION

The present invention obviates these drawbacks and is characterised in that the display means are designed for the generation of reflecting Fresnel zones on the Fresnel zone plate and in that the Fresnel zone plate is arranged for the generation, in reflection, of the antenna beam and in that a microwave radiation-reflecting surface positioned behind the Fresnel zone plate is provided for at least partially reflecting the microwave radiation passed by the Fresnel zone plate. This enables the portion of microwave radiation that could initially not contribute to the beam formation, to be used after all.

A favourable embodiment of the invention is characterised in that the distance between the Fresnel zone plate and the reflecting surface is at least substantially a quarter of the wavelength of the microwave radiation. This favourable selection enables substantially all microwave radiation to be used.

A favourable embodiment of the invention is obtained by designing the display means as a light source, for instance a laser plus deflection means and by designing the Fresnel zone plate as a plate of solid-state material in which the laser can generate free charges for obtaining substantially full reflection of the microwave radiation.

For certain applications, for instance in the nose of an aircraft, it may be advantageous to position the light source behind the Fresnel zone plate. This can be effected by designing the microwave-reflecting surface such that it is transparent to radation from the light source.

The microwave antenna thus obtained can, at least with regard to the energy budget, successfully compete with the far more expensive phased array antenna whose reflective surface is constituted by a plurality of phase-controllable elements. To also compete as regards the sidelobe level, the display means are required to display the Fresnel zones with an extremely high level of accuracy.

The problem that may be encountered here is that inaccuracies in the written Fresnel zones are in fact amplified by the reflective surface. A further favourable embodiment of the microwave antenna according to the invention is thereto characterised in that the reflective surface comprises a second Fresnel zone plate, provided with at least substantially complementary Fresnel zones. The microwave antenna is then provided with second display means for generating reflective Fresnel zones on the second Fresnel zone plate.

A further favourable embodiment of the invention is characterised in that the display means and the second display means comprise a light source each, for instance a laser plus deflection means, for generating free charges in the Fresnel zone plates.

To prevent the display means from illuminating the second Fresnel zone plate and the second display means from illuminating the Fresnel zone plate, it may be advantageous to place a screen between the Fresnel zone plate and the second Fresnel zone plate which allows microwave radiation to pass but does block radiation from the light sources.

As the distance to the microwave radiation source varies for the Fresnel zone plate and the second Fresnel zone plate, the two Fresnel zones are not exactly complementary. A still further embodiment is thereto characterised in that the display means generate Fresnel zones on the basis of the distance between the microwave radiation source and the Fresnel zone plate and in that the second display means generate Fresnel zones on the basis of the distance between the microwave radiation and the second Fresnel zone plate. A consequence is that particularly at the edge of the system of Fresnel zone plates, the zones show a slight deviation and possibly even an overlap. To prevent this, the Fresnel zones can be written with a width that amounts to 60–80% of the calculated width. This furthermore prevents a possible overlap as a result of the spreading of the Fresnel zones owing to the diffusion of free charges in the solid-state material.

In calculating the Fresnel zones, required for obtaining a certain deflection, it is of advantage to only involve the off-broadside angle in the calculation and to subsequently rotate the calculated Fresnel pattern, such that the beam required in space is obtained. This necessitates the microwave radiation source to generate a field of radial symmetry. A still further favourable embodiment of the invention is thereto characterised in that the microwave radiation source is provided with a feedhorn for generating an at least substantially spherical wave front to which, as is customary in illuminating an antenna, a weighting has been applied.

To realize a low-sidelobe microwave antenna, the customary procedure is to allow the feedhorn to realize a weighting on the antenna surface which on the one hand does not unduly enlarge the antenna beam width and on the other hand reduces the side lobes. An additional argument in case of the antenna described here is that near the edge of the antenna, the Fresnel contours may be situated quite closely together and that the required accuracy is hardest to achieve at the edge. This is particularly the case for antenna beams near broadside, where the Fresnel contours comprise a system of concentric circles. It is then relevant that the feedhorn allows for a suitable weighting for illuminating the arrangement of Fresnel zone plates such that the radiation field at the antenna edge is practically zero.

A further important parameter for the microwave antenna according to the invention concerns the distance between the feedhorn and the arrangement of Fresnel zone plates. On the one hand, this distance shall be wide since the concept of complementary Fresnel zones for the first Fresnel zone plate and the second Fresnel zone plate is only valid for a long distance. On the other hand, the distance shall be short since in case of off-broadside antenna beams, the Fresnel contours no longer constitute a system of concentric circles and accordingly complex, closely spaced contours move towards the centre of the Fresnel zone plates, where the favourable effect of the weighting performed by the feedhorn is no longer noticeable. Changing the contours is least perceptible if the feedhorn is located near the arrangement of Fresnel zone plates. A still further favourable embodiment of the invention is thereto characterised in that the distance between the feedhorn and the arrangement of Fresnel zone plates is 30–70 times the wavelength of the microwave radiation.

BRIEF DESCRIPTION OF THE DRAWINGS

The invention will now be further explained with reference to the following figures, of which.

DETAILED DESCRIPTION OF THE INVENTION

Figure 1:
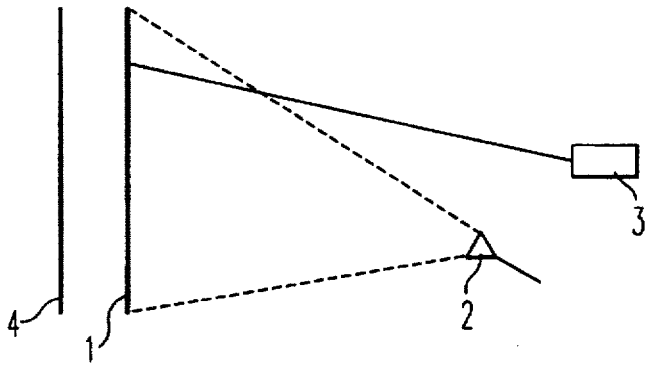
FIG. 1 schematically represents a microwave antenna provided with a Fresnel zone plate, a laser and a reflective surface.

In FIG. 1 a Fresnel zone plate 1 is illuminated by a feedhorn 2 that is connected to a microwave generator (not shown) or a microwave receiver (not shown) or to both, via a T/R device well-known in the art. Since the operation of the antenna is reciprocal, only the situation wherein feedhorn 2 is connected to a microwave generator will be considered. Fresnel zone plate 1 is provided with Fresnel zones that are applied to said plate as reflective portions comprising a substantial amount of free charges for instance by means of a laser 3 that is provided with deflection means. The deflection means are connected to a control device not shown here, which will usually comprise a digital computer for calculating the Fresnel zones and for consequently steering the deflection means. Fresnel zone plate 1 is constructed from semiconductor material, preferably silicon. As laser, a Nd-Yag or a solid-state laser may be used provided with acousto-optical deflection means well-known in the art. The wavelength of the laser shall be sufficiently short to generate free charges in the silicon. The antenna beam is formed in reflection, so that it may be advantageous to place feedhorn 2 in a slightly offset position so as to minimize the antenna side lobes generated by the shadow of the feedhorn 2. Approximately half the microwave radiation passes through Fresnel zone plate 1 and is reflected via microwave radiation-reflective surface 4 to contribute to the antenna beam formation. Since the average phase error of the microwave radiation allowed to pass through is 180 degrees, it is advantageous to place reflective surface 4 at a distance of a quarter of the microwave radiation wavelength behind the Fresnel zone plate. Thus, substantially all microwave radiation applied to the Fresnel zone is included in the antenna beam.

It is also possible to apply the Fresnel zones by means of a two dimensional array of solid-state lasers or a two-edimensional array of leds plus a lens, as described in WO 93/26059-A1. If low antenna sidelobes are required, this has the drawback that a great number of lasers and leds are necessary to attain the required resolution for the Fresnel zones.

Figure 2:
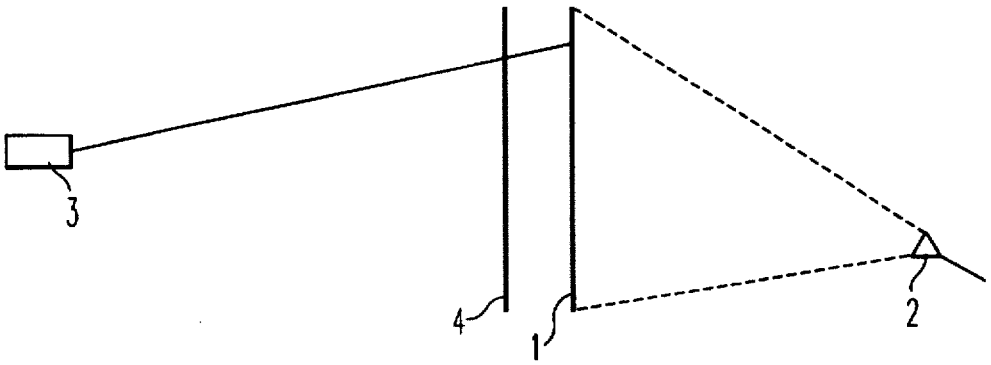
FIG. 2 schematically represents a microwave antenna provided with a Fresnel zone plate, a laser and a reflective surface transparent to laser radiation.

In FIG. 2, Fresnel zone plate 1 is also illuminated by the feedhorn 2, although here microwave radiation-reflective surface 4 is designed such that it is transparent to radiation from laser 3. This can for instance be realized by designing reflective surface 4 as a plurality of parallel wires situated in one plane. If such a plane is illuminated with polarized microwave radiation, the polarization direction of which is parallel, the reflection is practically complete. This has the advantage that laser 3 can be positioned behind the reflective surface 4, which enables a compact construction, for instance in the nose of an aircraft.

Figure 3:
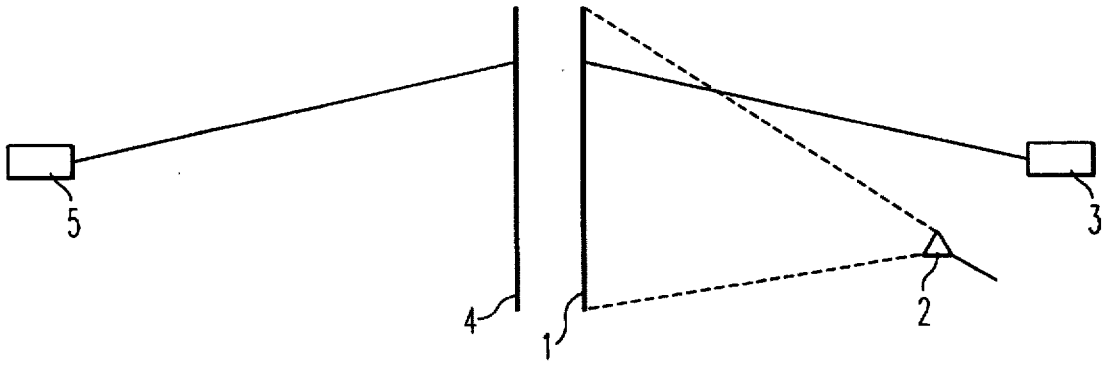
FIG. 3 schematically represents a microwave antenna provided with two Fresnel zone plates and two lasers

The principle of the Fresnel zone plate is for instance described in "Fundamentals of Optics", third edition, 1957, Jenkins and White, page 360, which also contains analytical expressions for calculating Fresnel zones. From this it appears that the Fresnel zones depend on the distance between feedhorn 2 and Fresnel zone plate 1. This means that the Fresnel zones on reflective surface 4 are not exact, because in reality these are the inverse Fresnel zones of the Fresnel zone plate. This may give rise to the occurrence of side lobes. As shown in FIG. 3, reflective surface 4 may therefore be advantageously designed as second Fresnel zone plate, on which the Fresnel zones can be written by the complementary display means 5 as calculated. To exploit this advantage, the width of the Fresnel zones may be slightly reduced to prevent overlap between the slightly deviating Fresnel zones. Since the microwave radiation on the edges of the Fresnel zones will be 90 degrees out of phase with respect to the central portions of the Fresnel zones, this hardly entails any losses. A screen 6 may be placed between the first and second Fresnel plates, where screen 6 allows microwave radiation to pass but blocks radiation from a light source.

For generating an antenna beam with a predetermined direction, a suitable arrangement of Fresnel zones shall be calculated and applied to the Fresnel zone plates. The calculation of the Fresnel zones follows directly from the known Fresnel theory based on spherical wave fronts. For a forward-looking antenna with a feedhorn positioned centrally in front of a Fresnel zone plate, the Fresnel zones consist of a disc-shaped central spot surrounded by a number of concentric circles, the radius of circle m being parallel to the square root of m. The circles consequently become narrower and closer together. For an antenna not radiating perpendicular to the antenna plane or for an offset feedhorn, these circles appear to have changed into complex, more or less elliptical contours. For each direction, the contours may be simply calculated by dividing the surface of the Fresnel zone plate to be determined into an array of elements and by determining per element the pathlength of microwave radiation leaving the feedhorn, via the element, to a reference plane perpendicular to the desired radiation direction. The elements for which this pathlength differs not more than ¼ wavelength with a reference length to be selected, for instance the distance of the reference plan to the centre of the Fresnel zone plate, are made reflective, thus constituting the Fresnel zone plate. Obviously the pathlengths are determined modulo the wavelength of the microwave length.

To reduce the reflection of microwave radiation on non-activated silicon for microwave radiation, an anti-reflection coating may be applied to the silicon. This coating may also serve as support structure for the silicon which will usually have a small thickness, for instance in the order of 100 micrometer.

When using pure silicon, the carrier life of free charges in the silicon may be a few milliseconds. It may then suffice to refresh the laser-written image every millisecond. If required, the carrier life of free charges may be reduced by doping the silicon. This enables a faster control of the antenna. Additionally, this reduces the diffusion of free charges in the silicon, which diffusion tends to blur Fresnel zone edges and to widen the Fresnel zones. A similar effect can be obtained by selecting the silicon to be thin and by not passivating it, or by subjecting the silicon to a surface treatment which enhances surface recombination.

In selecting a weighting function for illuminating the Fresnel zone plate with microwave radiation, it is advantageous to select a weighting function that becomes small at the edge of the Fresnel zone plate. This selection is customary in the art, but in the present invention it has the added advantage that it reduces the relative importance of the edge of the Fresnel zone plate, where the Fresnel zones are narrow and closely spaced.

In calculating the Fresnel zones, a spherical reference surface perpendicular to the direction of the radiation may be an acceptable alternative for a planar reference surface. The resulting radar beam will then diverge more. Thus, a wider beam may be selected, which may be advantageous during a search scan in the acquisition phase of a tracking radar equipped with the microwave antenna according to the invention.

I claim:

1. A microwave antenna which generates in reflection an antenna beam with adjustable parameters, comprising:

an active microwave radiation source;

a first plate comprising a semiconductor material;

first display means for writing a first set of Fresnel zones into the first plate;

a second plate comprising a semiconducting material; and second display means for writing a second set of Fresnel zones into the second plate, wherein the second set of Fresnel zones is at least substantially complementary to the first set of Fresnel zones, and respective Fresnel zones in said second set are written with a width that is in a range of 60% to 80% of a calculated width based on a distance between the microwave radiation source and the second plate in which said second set of Fresnel zones is written.

2. The microwave antenna as claimed in claim 1, wherein said active microwave radiation source produces microwave radiation having a wavelength, and a distance between the first plate and the second plate is a quarter of the wavelength of the microwave radiation.

3. The microwave antenna as claimed in claim 2, wherein said microwave radiation source comprises:

a feedhorn which generates a weighted, at least substantially spherical microwave front.

4. The microwave antenna as claimed in claim 3, wherein the feedhorn is positioned from at least one of the first and second plate by a distance of 30–70 times the wavelength of the microwave radiation produced by the microwave radiation source.

5. The microwave antenna as claimed in claim 1, wherein the first plate and the second plate each comprise a planar surface, which comprises silicon, and having a thickness in the range of 50 microns to 200 microns.

6. The microwave antenna as claimed in claim 1, wherein the first and second plates comprise an anti-reflection coating.

7. The microwave antenna as claimed in claim 1, wherein at least one of said first and second plates comprise means for reducing a carrier life time of a free charge produced by at least one of the first display means and the second display means.

8. The microwave antenna as claimed in claim 7, wherein said reducing means comprises at least one of the semiconductor material and the semiconducting material.

9. The microwave antenna as claimed in claim 7, wherein the reducing means comprises at least one layer of a surface recombination material applied to at least one of said first plate and said second plate by a surface treatment for enhancing surface recombination.

10. The microwave antenna as claimed in claim 7, wherein said reducing means comprises a doping means for doping the semiconductor material.

11. The microwave antenna as claimed in claim 1, wherein said semiconducting material comprises a same material as said semiconductor material.

* * * * *